US006345414B1

(12) United States Patent
Chen

(10) Patent No.: US 6,345,414 B1
(45) Date of Patent: Feb. 12, 2002

(54) COLLAPSIBLE HANDLE FOR A PORTABLE LUGGAGE

(76) Inventor: Chieh-Chiung Chen, No. 56, Min Sheng Street, Feng-Yuan City 42041 (TW)

( * ) Notice: Subject to any disclaimer, the term of this patent is extended or adjusted under 35 U.S.C. 154(b) by 0 days.

(21) Appl. No.: 09/507,306

(22) Filed: Feb. 18, 2000

(51) Int. Cl.[7] ..... A45C 5/14

(52) U.S. Cl. ..... 16/113.1; 190/18 A; 280/655.1; 280/47.2

(58) Field of Search ..... 16/113.1, 429; 280/655, 655.1, 47.371, 47.2; 190/18 R, 18 A, 100, 115, 117

(56) References Cited

U.S. PATENT DOCUMENTS 5,207,439 A * 5/1993 Mortenson ..... 280/47.2
5,519,919 A * 5/1996 Lee ..... 16/113.1
5,568,848 A * 10/1996 Liang ..... 190/18 A
5,590,748 A * 1/1997 Chang ..... 16/113.1
5,788,260 A * 8/1998 Huang ..... 280/655
5,873,439 A * 2/1999 Liang ..... 190/18 A
5,984,326 A * 11/1999 Abraham et al. ..... 190/18 A
6,016,893 A * 1/2000 Chen et al. ..... 190/18 A
6,047,798 A * 4/2000 Lin ..... 16/113.1
6,082,510 A * 7/2000 Liang ..... 190/18 A
6,164,425 A * 12/2000 Latshaw ..... 190/18 A
6,182,981 B1 * 2/2001 Kuo ..... 190/18 A

* cited by examiner

*Primary Examiner*—Lynne H. Browne
*Assistant Examiner*—Doug Hutton

(57) ABSTRACT

A collapsible handle for a portable luggage is provided. The handle includes an upper seat and a lower seat spacedly secured to the top and lower portions of the back side of the portable luggage, an attachment slidably pivoted to a pair of rectangular recesses of the upper seat, an elongate caster seat including a pair of subordinate casters pivoted on two end which has an arcuate lower surface made engageable with a concaved engaging surface in the top of the lower seat, a pair of telescoped frame having their upper ends inserting through the attachment and secured to a handle grip above the attachment and their lower ends of the outmost portion secured to a pair of cavities at two end of the elongate caster seat and the inner portion respectively biased by a pair of post of a locking member which is in turn biased by a pair of springs inside the elongate caster seat.

1 Claim, 11 Drawing Sheets

(4—4)

(4'—4')

COLLAPSIBLE HANDLE FOR A PORTABLE LUGGAGE

BACKGROUND OF THE INVENTION

The present invention relates to luggage and more particularly to a collapsible handle attached to a portable luggage which the handle can also be released to serve as a support of the luggage in order to share the weight of the luggage.

Typical portable luggage (as shown in FIG. 1) comprises a case 10, a pair of casters 11 spacedly attached to the lower corners, a lower seat 12 and a upper seat 13 spacedly secured to the back of the case 10, a pair of sleeves 15 spacedly connected with the seat 12 and 13, a U-shaped handle 14 telescoped into the sleeves 15 and fixed by a lock 16 in the lower seat 12. When a user presses the lock, the handle 15 will be released to draw out of the sleeves for pulling the case 10 as well as pulling a trolley car with the user during a travelling. Although the weight of the case 10 is mostly supported by the casters 11, but a certain portion of the weight of the case is supported by the user's hard. If the case contains heavy object the user will be exhausted.

SUMMARY OF THE PRESENT INVENTION

The present invention has a main object to provide a collapsible handle for a portable luggage which handle has a pair of subordinate casters on lower end and can be rotatable released from the case in order to share a certain portion of the weight of the case which is usually supported by user's hand.

Another object of the present invention is to provide a collapsible handle for a portable luggage which can be structured as a stroller for a user to easily push or pull during a travelling.

The present invention will become more fully understood by reference to the following detailed description thereof when read in conjunction with the attached drawings.

DETAILED DESCRIPTION OF THE PREFERRED EMBODIMENT

Figure 1:
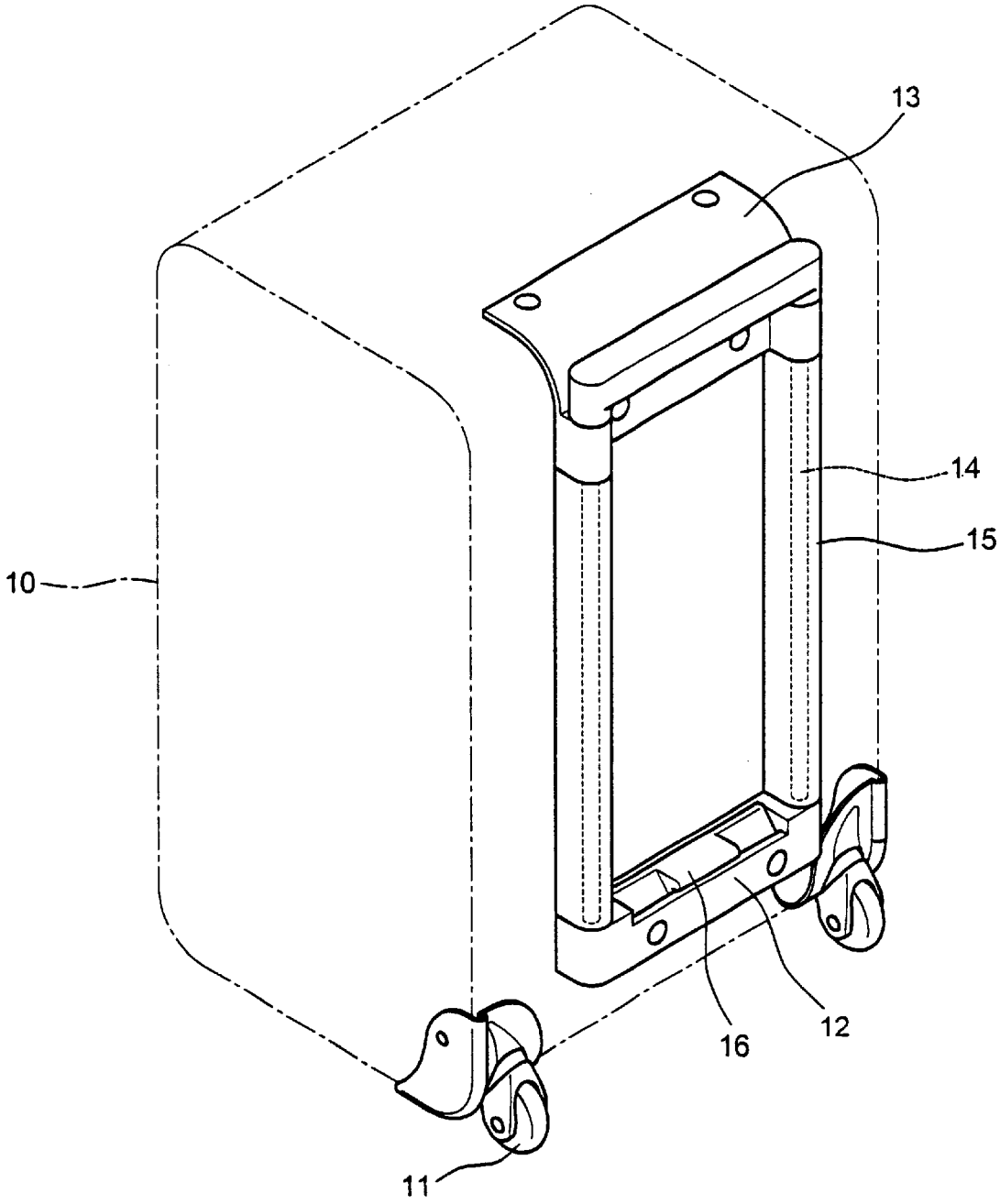
FIG.1 Prior Art
FIG. 1 is a perspective view to show a portable luggage according to a prior art.
Figure 2:
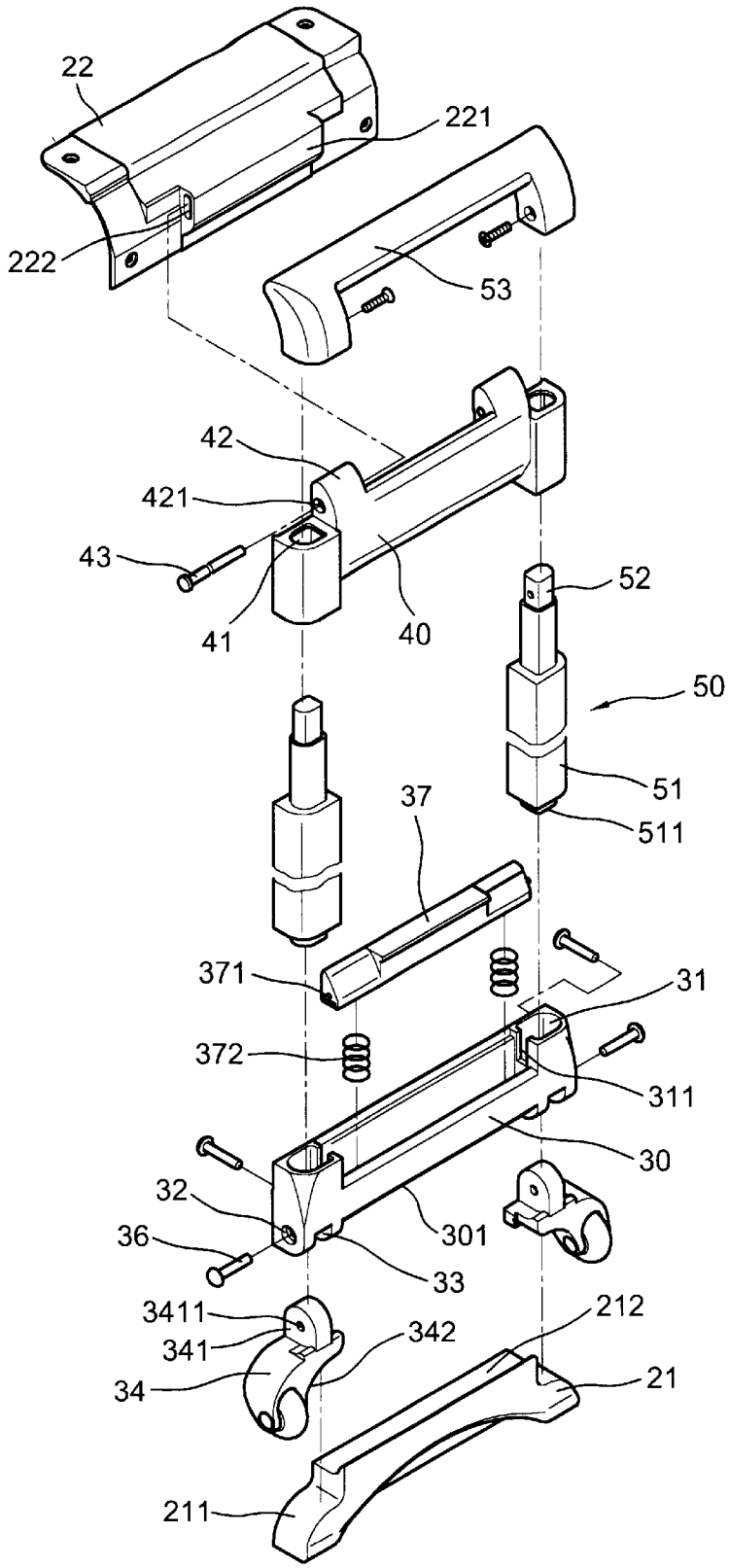
FIG. 2 is an exploded perspective view of a collapsible handle of the preferred embodiment according to the present invention.
Figure 3:
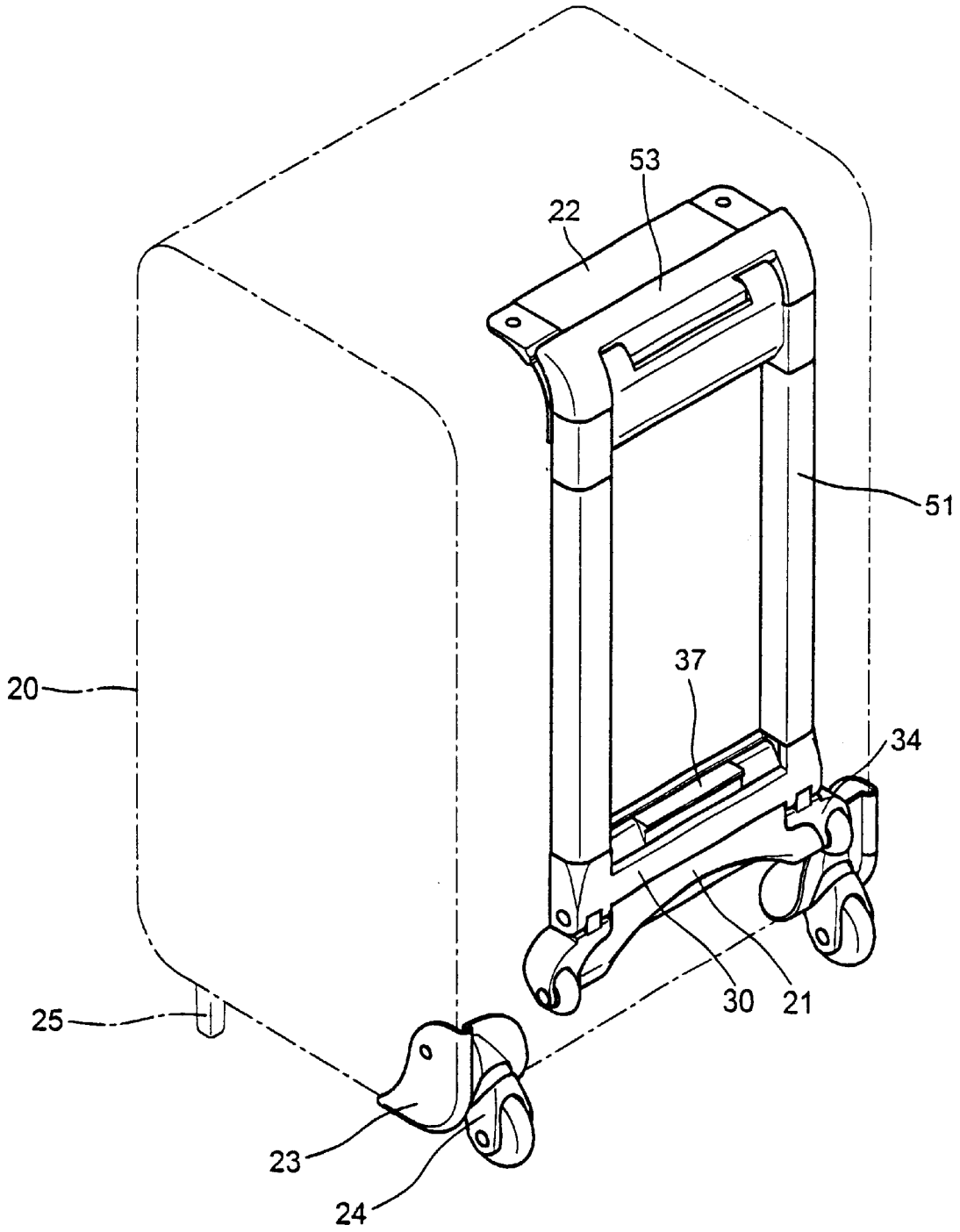
FIG. 3 is a perspective view to show the collapsible handle of the present invention attached to the back of a portable luggage.

With reference to FIGS. 2 and 3 of the drawings, the collapsible handle for a portable luggage of the present invention comprises generally a portable luggage 20 having a pair caster seats 23 fixed spaced apart to the lower corners on the back side for securing a pair of main casters 24 and pair of feet 25 spacedly projected downward from the bottom remote to the casters 24, a lower seat 21 centrally secured to a lower portion of the back side and an upper seat 22 centrally secured to the top of the back side.

The lower seat 21 includes a pair of first arcuate engaging surfaces 211 disposed at two ends with the arcuate surfaces facing upward and a concaved engaging surface in the top.

The upper seat 22 includes an extension 221 centrally extended outward and a rectangular recess 222 in each end of the extension 221.

An elongate caster seat 30 includes an arcuate lower surface 301 engageable with the concaved engaging surface 212 of the lower seat 21 a pair of cavities 31 are disposed at two ends of the elongate caster seat 30 with openings facing upward, each cavity having vertical slit 311 in inner side, a pair of lugs 33 spacedly extended downward from the under side directly under the cavities 31. Each lug 33 having a first lateral axial hole 32, a pair of subordinate casters 34 each having a protrudent coupler 341 projected upward with a second lateral axial hole 3411 for rotatably engaging the casters 34 with the lugs 33 of the caster seat 30 by an axial pin 36. The casters 34 each having a second arcuate surface 342 on its bottom side is made engageable with the first arcuate surfaces 211 of the lower seat 21. A locking member 37 disposed in the caster seat 30 between the pair of cavities 31 and biased by a pair of springs 372 on under side. A pair of posts 371 are disposed and projected outward at two ends of the locking member 37 which are respectively sliding into the vertical slits 311 of the caster seat 30.

An attachment 40 has a pair of positioning vertical bores 41 respectively formed at two ends, a pair of coupling projections 42 spacedly projected upward from the top adjacent the vertical bores 41 and each including a third lateral axial hole 421 for slidably pivoting the attachment 40 to the rectangular recesses 222 of the upper seat 22.

A handle 50 includes a pair of telescoped frames 51 each having an upper end respectively inserted through the vertical bores 41 of the attachment 40 and secured to a U-shaped handle grip 53 above the attachment and a lower end of an outmost portion fixedly secured on the cavities 31 of the elongate caster seat 30 and two inner portions 511 of said pair of telescoped frames which are pressed against by the posts 371 of the locking member 37 respectively.

Figure 4:
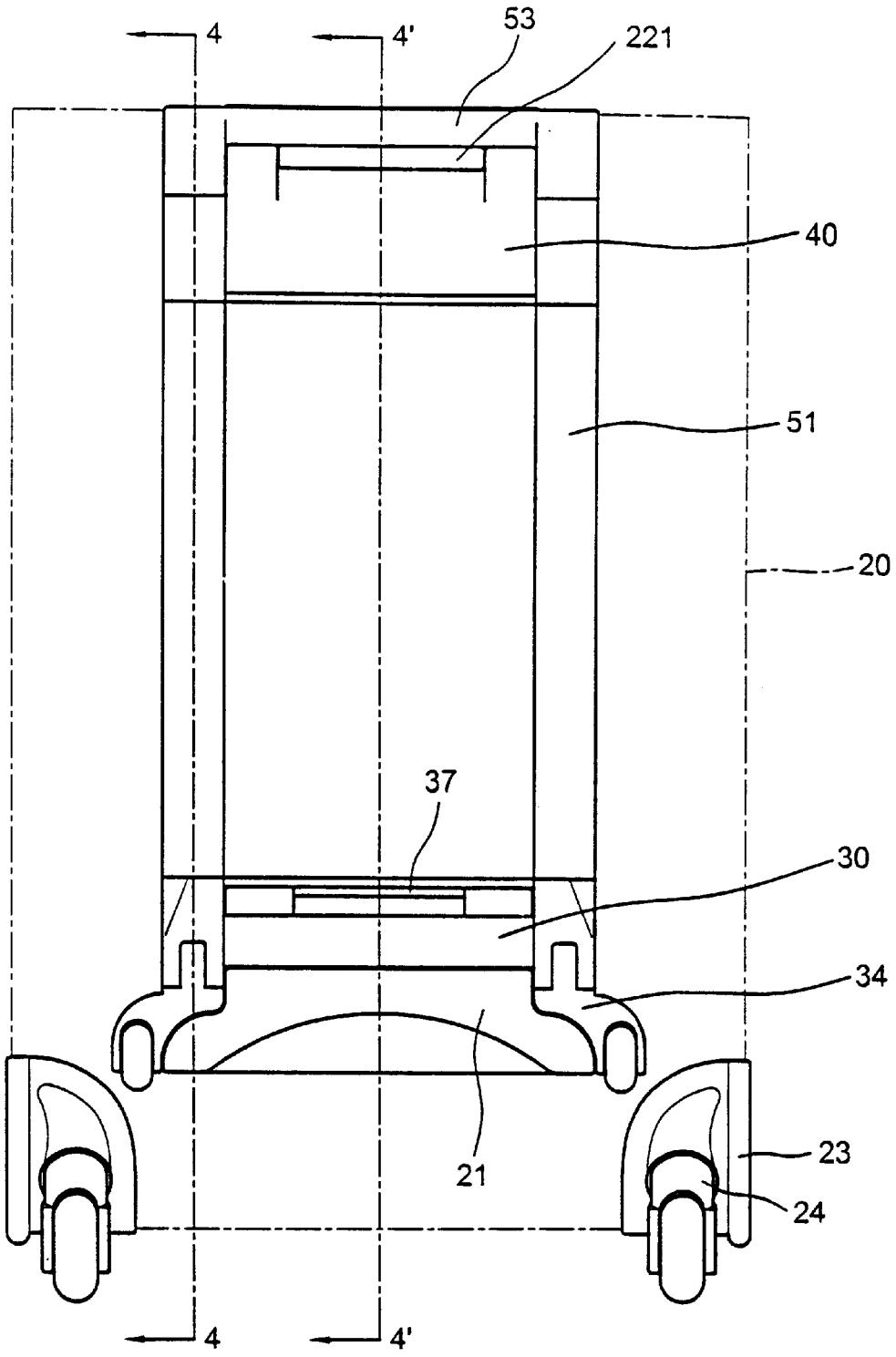
FIG. 4 is a front view of FIG. 3.
Figure 5:
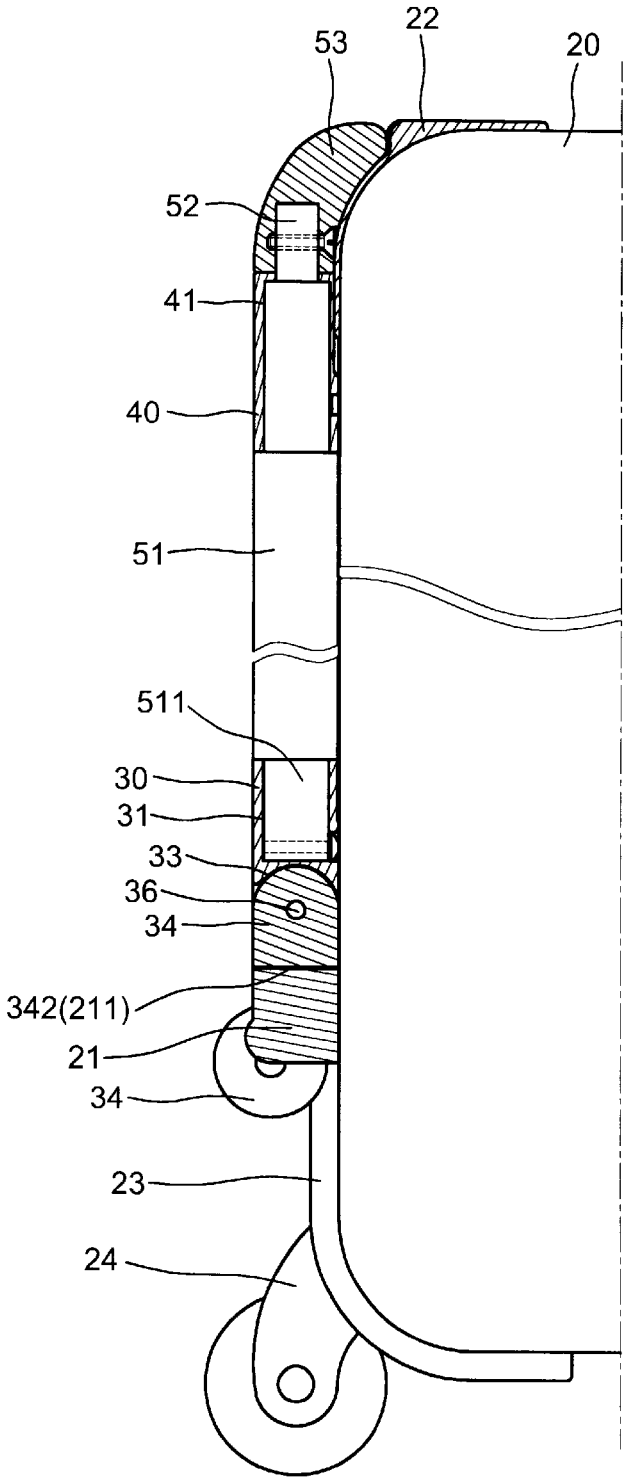
FIG. 5 is a sectional view taken along line 4—4 of FIG. 4.
Figure 6:
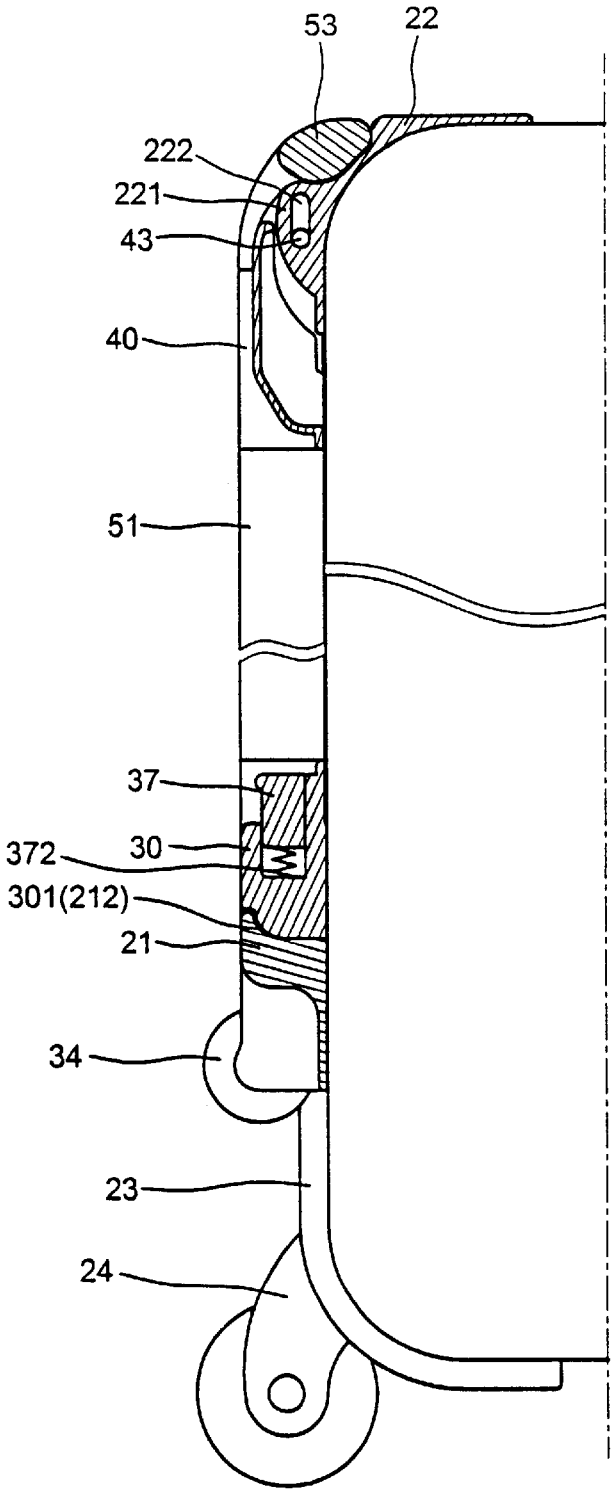
FIG. 6 is a sectional view taken along line 4'—4' of FIG. 4.

Referring to FIGS. 4, 5, and 6, FIG. 4 shows the collapsible handle is normally attached to the back of the portable luggage 20 where the arcuate engaging surfaces 211 and 342 of the lower seat 21 and the subordinate casters 34 are firmly engaged with each other (as shown in FIG. 5) and the arcuate lower surface 301 of the elongate caster seat 30 is firmly engaged within concaved engaging surface 212 of the lower seat 21 (as shown in FIG. 6).

Figure 7:
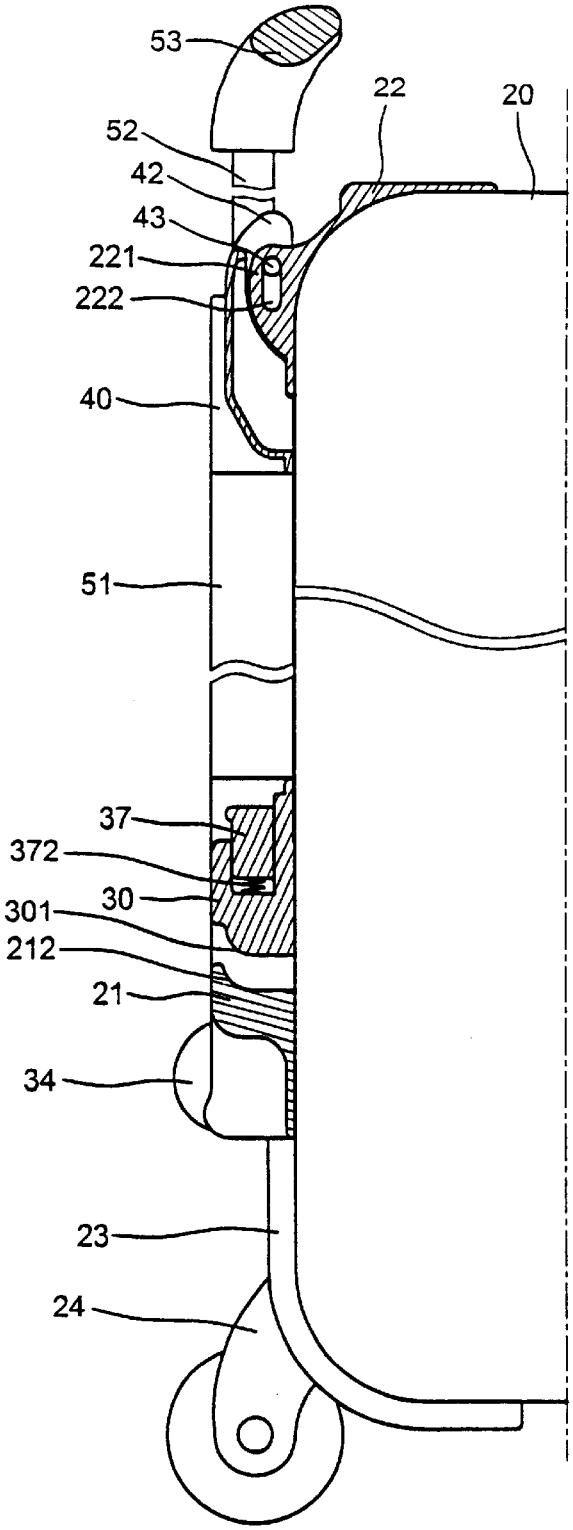
FIG. 7 is a sectional view indicating the handle that is released from the lower seat.
Figure 8:
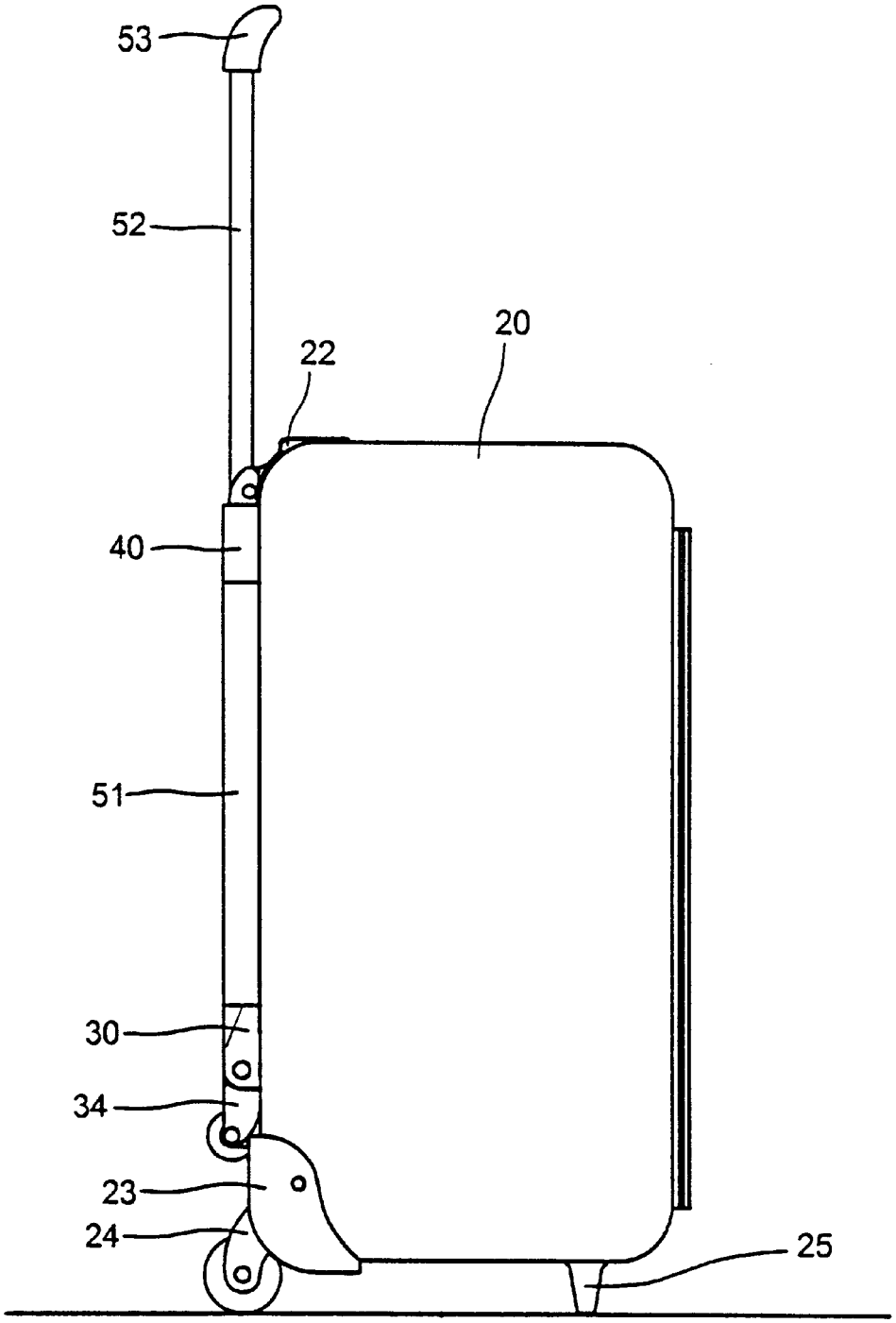
FIG. 8 is a side view to show that the handle is drawn upward from the sleeves.
Figure 9:
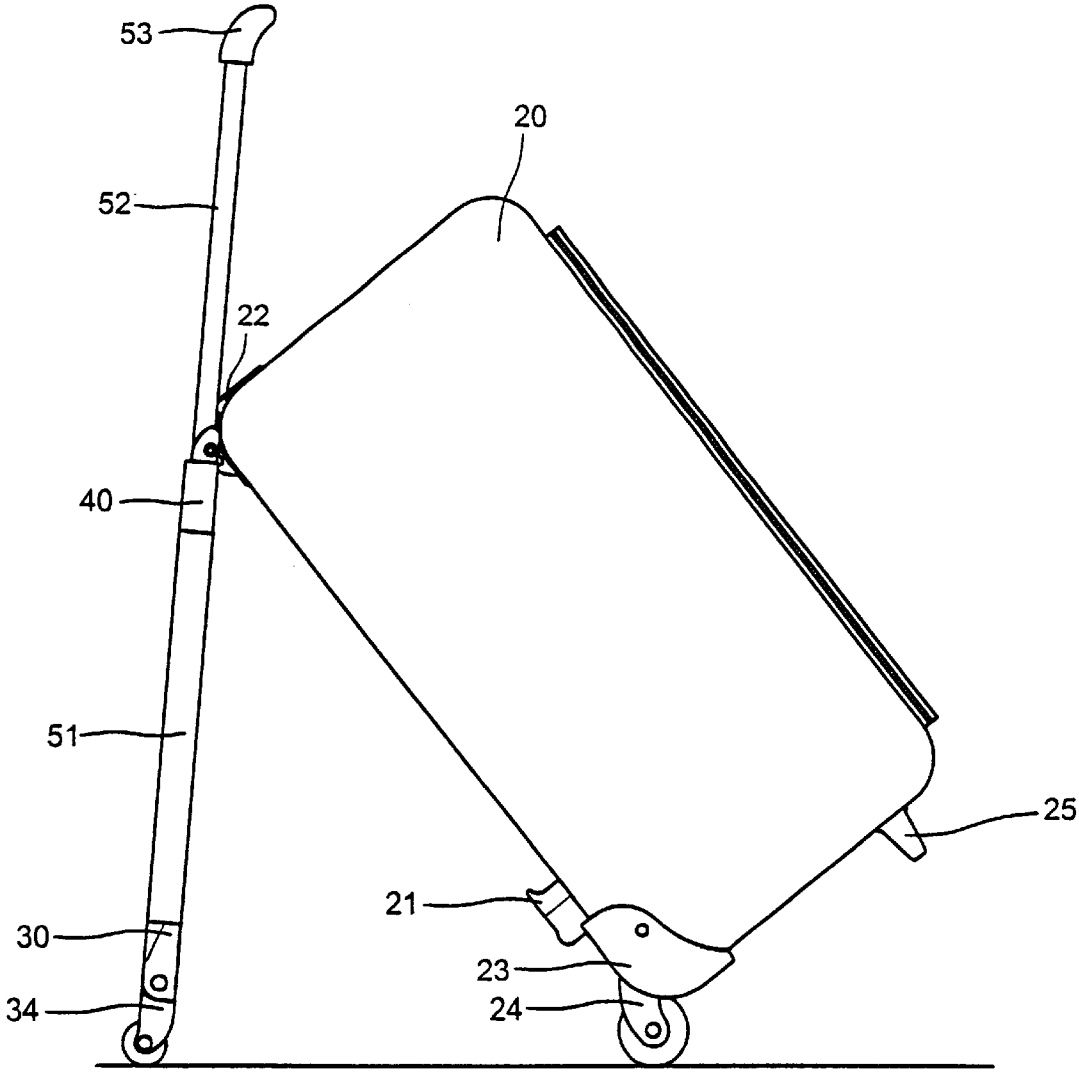
FIG. 9 is a side view to show that the handle is rotatably released from the luggage.

Referring to FIGS. 7 and 8, when press the locking member 37 downward, the telescoped frame can be drawn upward (as shown in FIG. 7) and when the frame 51 is drawn mostly upward, it will push the attachment to slide upward in the rectangular recesses 222 of the upper seat 22 so it defines a space to facilitate both of the arcuate lower surface 301 of the elongate caster seat 30 and the arcuate engaging surface 342 of the subordinate casters 34 disengaged with the cancaved engaging surface 212 and the arcuate engaging surfaces 211 of the lower seat 21 (as shown in FIG. 8), where the frame can be rotated on the pin 43 to come apart from the luggage 20 and serving as a support of the luggage 20 which can tilt and lean toward the frame (as shown in FIG. 9).

Figure 10:
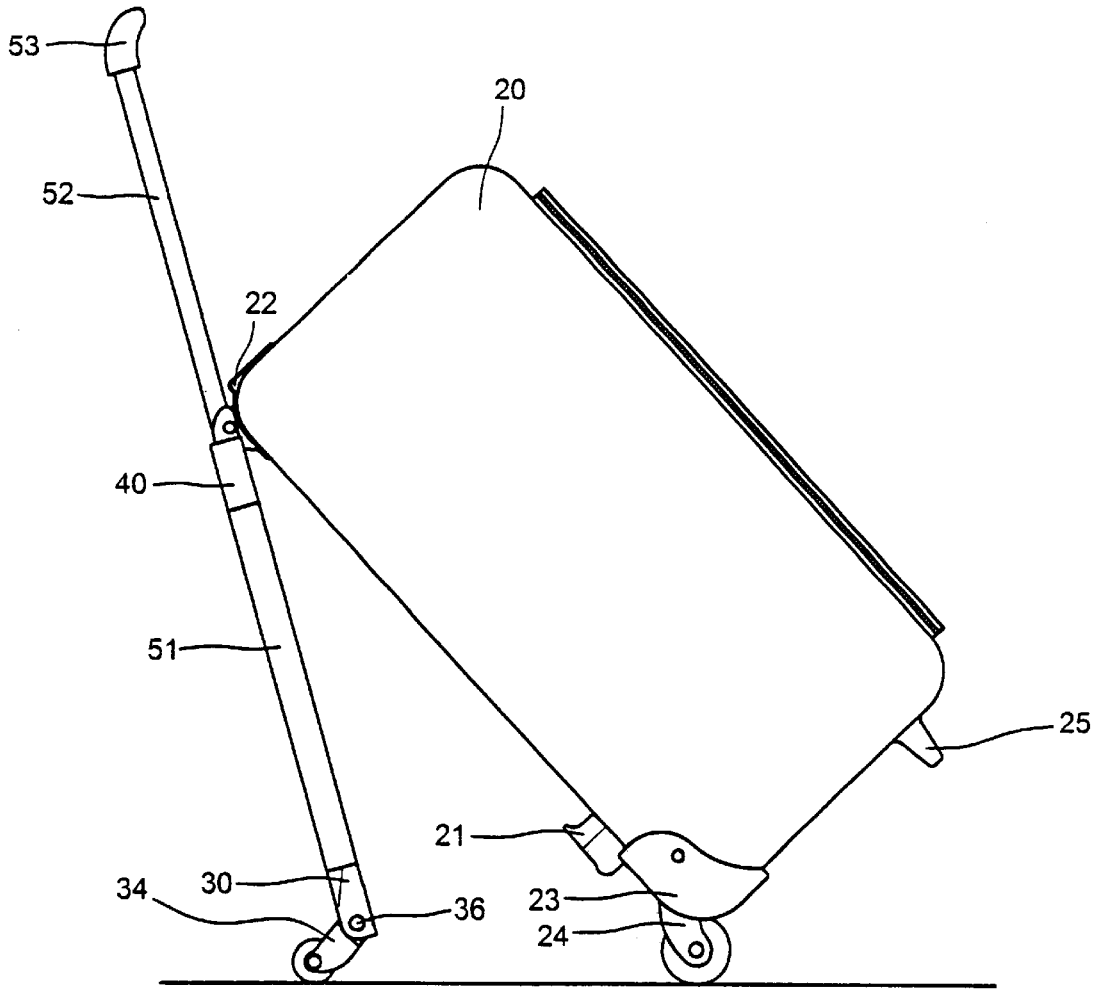
FIGS. 10 and 11 are the side views to show that the handle is rotating forward to lessen the angle between the handle and the luggage so that a stroller is structured to facilitate a user to easily push or pull the luggage.
Figure 11:
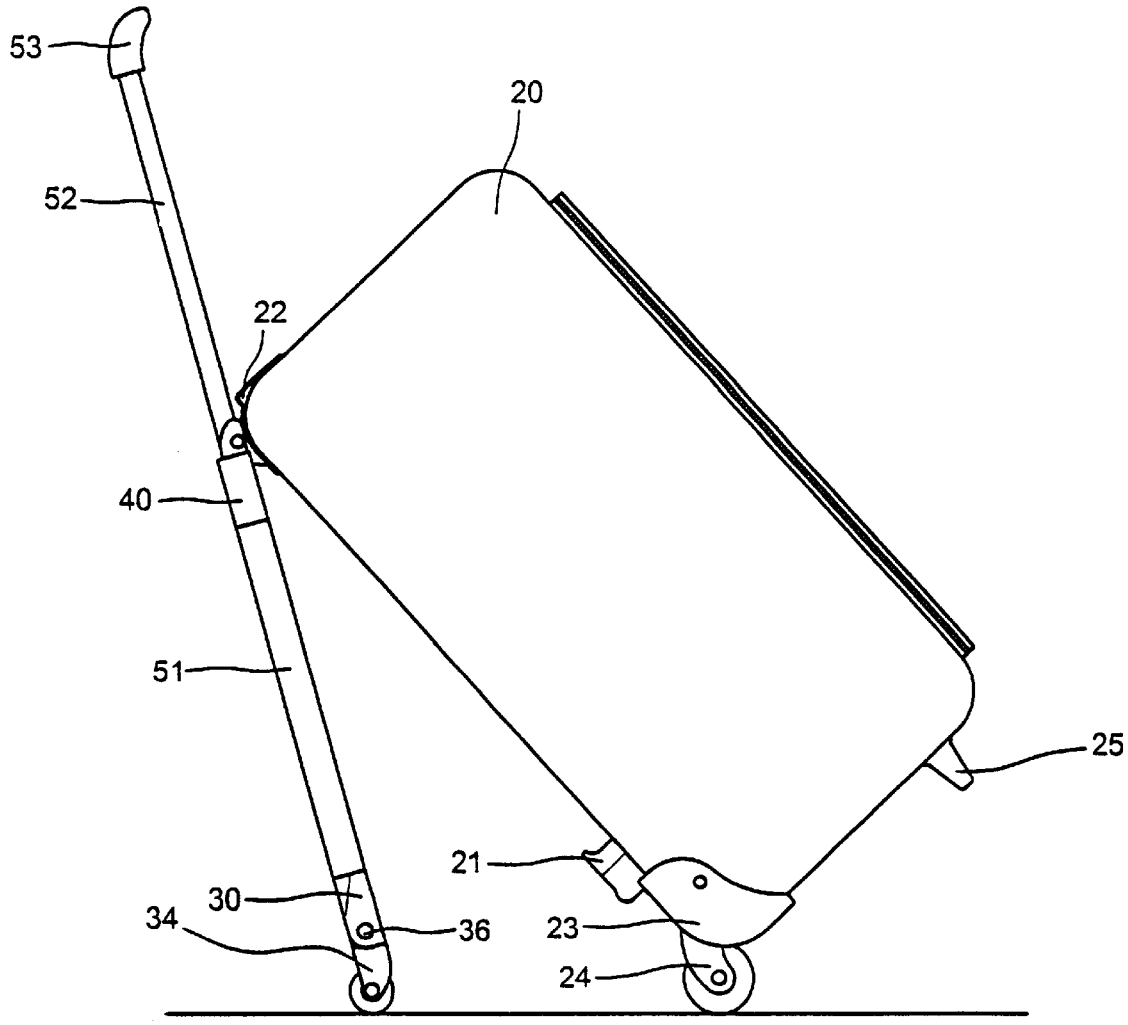

Referring to FIGS. 10 and 11, when push the handle grip 53 forward, the subordinate casters 34 will rotate rearward on the pin 36 so as to form an angle between the subordinate casters 34 and the caster seat 30 because of the eccentric action, therefore the tilt luggage can stand steadfastly on the main casters 24 and the subordinate casters 34 so that the luggage can be pushed forward as the same way we usually push a stroller. It is better to pull the luggage 20 when walk on an uneven surface. The way is that first lift the handle upward to disengage the subordinate casters 34 with the ground, the put it down, the subordinate casters 34 is line up with the caster seat 30 as it touches the ground again. This time, the weight of the luggage 20 is mostly supported by the main casters 24 and partially bearded by the pin 43 which is positioned at the middle of the handle. According to the second principle of lever, it saves a lot of energy (as shown in FIG. 11). Further, the pin 43, under such great downward pressure shall be damageable. However, such pressure is moderated by the rectangular recesses 222 of the upper seat 22.

When collapse the handle onto the luggage 20, one just rotates the handle inward and presses the locking member 37 downward again, the arcuate engaging surfaces 301 and 342 of the caster seat and the subordinate caster 34 will be automatically engaged in place with the concaved engaging surface 212 and the arcuate engaging surface 211 of the lower seat 21.

The specification relating to the above embodiment should be construed as exemplary rather than as limitative of the present invention with many variations and modifications being readily attainable by a person of average skill in the art without departing from the spirit or scope thereof as defined by the appended claims and their legal equivalents.

I claim:

1. A collapsible handle for a portable luggage comprising:

a luggage having a pair of main casters respectively secured and spaced apart to a pair of lower corners on a back side thereof and a pair of foot members spacedly projected downward from a bottom thereof remote to the main casters;

a lower seat centrally secured to a lower portion on the back side of the luggage having a pair of first arcuate engaging surfaces disposed at two ends of said lower seat with arcuate surfaces facing upward and a concaved engaging surface on a top between said first arcuate engaging surfaces;

an upper seat centrally secured to a top of the back side of the luggage having an extension centrally extended outward and a pair of rectangular recesses formed in two ends of the extension;

an elongate caster seat having an arcuate lower surface engageable with the concaved engaging surface of said lower seat a pair of cavities with openings facing upward are disposed at two ends of said elongate caster seat and each cavity having a vertical slit in an inner side, a pair of lug members spacedly extending down from under side directly under said cavities each including a first lateral axial hole a pair of subordinate casters each having a protruded coupler with a second lateral axial hole for securing to said lug members rotatably by means of first axial pins and a second arcuate engaging surface made engageable with the first arcuate engaging surfaces of said lower seat, and a locking member disposed into said elongate caster seat and biased by a pair of spring means said locking member having a pair of posts projected outward from its two ends and can slide into the vertical slits of said elongate caster seat;

an attachment having a pair of positioning vertical bores respectively formed at two ends thereof, a pair of coupling projections spacedly projecting upward from a top adjacent said vertical bores and each including a third lateral axial hole for slidably pivoting said attachment to the rectangular recesses of said upper seat; and a pair of telescoped frames having their upper ends respectively inserting through the positioning vertical bores of said attachment and secured to a U-shaped handle grip above said attachment and their lower ends each secured on top of said cavities of said elongate caster seat and two inner portions of said pair of telescoped frames are facing each other and are pressed against by the posts of said locking member.

* * * * *